US005544785A

United States Patent [19]

Frigiere

[11] Patent Number: 5,544,785

[45] Date of Patent: Aug. 13, 1996

[54] RESERVOIR OF GASEOUS FUEL IN LIQUID PHASE

[75] Inventor: Rene Frigiere, Charbonnieres les Bains, France

[73] Assignee: Cricket, Rillieux la Pape, France

[21] Appl. No.: 302,738

[22] PCT Filed: Jan. 18, 1994

[86] PCT No.: PCT/FR94/00063

§ 371 Date: Nov. 29, 1994

§ 102(e) Date: Nov. 29, 1994

[87] PCT Pub. No.: WO94/17334

PCT Pub. Date: Aug. 4, 1994

[30] Foreign Application Priority Data

Jan. 19, 1993 [FR] France ..... 93 00683

[51] Int. Cl.[6] ..... B67D 5/00

[52] U.S. Cl. ..... 222/3; 222/187

[58] Field of Search ..... 222/3, 187, 464; 431/344; 206/0.7

[56] References Cited

U.S. PATENT DOCUMENTS 4,063,665 12/1977 Schneider et al. ..... 222/187
4,729,494 3/1988 Peillon et al. ..... 222/3
5,083,916 1/1992 Glennon et al. ..... 431/344

FOREIGN PATENT DOCUMENTS 0202172 11/1986 European Pat. Off. .
0447330A1 9/1991 European Pat. Off. .
WO86/05259 9/1986 WIPO .

*Primary Examiner*—Andres Kashnikow
*Assistant Examiner*—Philippe Derakshani
*Attorney, Agent, or Firm*—Oliff & Berridge

[57] ABSTRACT

A reservoir for gaseous fuel in a liquid phase includes an elongate cylindrical wall closed by two transverse end walls, a lower end wall provided with a draw-off orifice and an upper end wall equipped with a draw-off member such as a valve and a pressure reducer, and has an internal volume occupied by an absorbent medium. A chamber is provided above the absorbent medium, between the absorbent medium and the upper end wall of the reservoir. The volume of the chamber is at least equal to the volume of the liquid fuel not absorbed by the absorbent medium after turning the reservoir upside down. The draw-off orifice is equipped with a draw-off tube of fine bore, which is positioned upstream of the pressure reducer and is housed axially in the chamber. The length of the draw-off tube is at least equal to the height of the fuel in the liquid phase that may be in the chamber when the reservoir is in an inverted position.

6 Claims, 1 Drawing Sheet

RESERVOIR OF GASEOUS FUEL IN LIQUID PHASE

BACKGROUND

The present invention relates to a reservoir of gaseous fuel in liquid phase and more particularly to a removable reservoir or cartridge for an apparatus using the combustion of this gas.

Such a reservoir, which is generally of cylindrical shape, has a filling orifice at the centre of its bottom and, at its end opposite the bottom, a draw-off orifice equipped with a draw-off member such as a valve and with an pressure reducer/evaporator, such as a porous element of permeability suited to the desired flow rate.

The objective to be achieved is to store the greatest quantity of fuel in liquid phase in this reservoir, without it being-possible for the liquid phase to reach the pressure reducer, which would cause spluttering deleterious to correct functioning of the apparatus onto which this reservoir is fitted.

One solution consists in storing the liquefied fuel in an absorbant in which it is retained in the liquid state by capillary forces. The absorbant is characterized by its nature and its density; it may also be characterized, in use, by the capillary rise of the absorbed liquid when equilibrium is reached, that is to say when the gravitational forces are balanced by the capillary forces.

The document EP-A-0 202 172 relates to a reservoir for liquid gas, entirely filled with an absorbent material, inside which there is provided a perforated central duct in which a dip tube, intended for the outlet of the gas from the reservoir, is engaged with a clearance.

The document EP-A-0,447,330 relates to a reservoir of fuel stored in liquid phase, the fuel being trapped within a porous or fibrous substance filling the reservoir. This reservoir comprises a dip tube connecting the outlet orifice to the centre of the reservoir.

A certain number of absorbent media have been tested and the capillary rise measured is of the order of 100 mm. This height of capillary rise therefore determines, depending on the other dimensions, the maximum capacity of liquid absorbed.

If the greatest dimension of the reservoir is greater than this 100 mm value, it is not possible to fill the reservoir beyond this .maximum capacity without running the risk of having fuel in free-liquid phase which may reach the pressure reducer, especially if the reservoir is held with its draw-off orifice in the down position.

SUMMARY OF THE INVENTION

The object of the invention is to provide a reservoir of gaseous fuel in liquid phase, which includes a volume of liquid gas in excess with respect to the volume absorbed by an absorbent material, and in which the liquid phase does not reach the pressure reducer, even after turning the reservoir upside down, during which movement a certain part of the liquid gas is desorbed, that is to say is no longer retained by the absorbent material.

For this purpose, the reservoir to which it relates, of the type including an elongate cylindrical wall closed by two transverse end walls, one the lower one and the other the upper one provided with a draw-off orifice equipped with a draw-off member such as a valve and with a pressure reducer, its internal volume being occupied by an absorbent medium, is characterized in that a chamber is provided above the absorbent material, between the latter and the upper end wall of the reservoir, the volume of which is at least equal to the volume of fuel in liquid phase in excess increased by the volume of liquid fuel released by the absorbent medium after turning the reservoir upside down, and in that the draw-off orifice is equipped with a draw-off tube, of fine bore, positioned upstream of the pressure reducer/evaporator, housed axially in the top chamber, and the length of which is at least equal to the height of fuel in liquid phase which may be in this chamber when the reservoir is in inverted position.

When the reservoir is inverted, the excess of fuel in liquid phase occupies the chamber located between the absorbent medium and the upper end wall of the reservoir, without reaching the free end of the draw-off tube.

According to one embodiment of this reservoir, the absorbent medium is formed by cellulose-based non-woven fiber.

Advantageously, in order to reduce the time for absorption of the fuel in liquid phase by the absorbent medium, a central absorption channel is formed along the longitudinal axis of the absorbent medium.

With the aid of such a channel, it is possible to obtain an absorption rate of the order of 35 $cm^3$/min. In such a configuration, when the reservoir passes from an inverted position to an upright position, the time necessary for the absorption of the liquid which had been released previously by the absorbent medium is considerably reduced. This arrangement eliminates any risk of seeing the free end of the draw-off tube immersed, even momentarily, in fuel in liquid phase.

Advantageously, the draw-off tube is placed on the axis of the central channel of the absorbent medium, and its free end is placed in the plane of the upper face of the absorbent material.

According to one possibility, the upper face of the absorbent material is formed by a convex surface, the vertex of which protrudes towards the side of the lower end wall of the reservoir.

BRIEF DESCRIPTION OF THE DRAWINGS

In any event the invention will be well understood with the aid of the description which follows, with reference to the appended diagrammatic drawings representing, by way of non-limiting examples, two embodiments of this reservoir.

DESCRIPTION OF PREFERRED EMBODIMENTS

Figure 5:
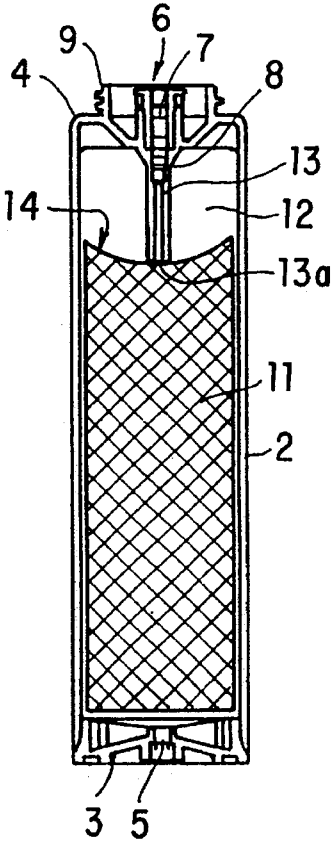
FIG. 5 is view of a variant of the reservoir of FIG. 1.

As shown in the drawings, the reservoir of fuel stored in liquid phase according to the invention includes an elongate cylindrical wall 2 closed at its ends by two circular end walls, respectively a lower circular end wall 3 and an upper circular end wall 4.

The lower end wall 3 is provided with a filling orifice 5 of a known type and consequently is not described in detail. The upper end wall 4 has, in addition to the means for connecting the apparatus which this reservoir is intended to supply, a draw-off orifice 6 equipped in a manner known per se with a draw-off member such as a valve 7 and with an pressure reducer/evaporator 8.

In the example illustrated in the drawing, the means for connecting this reservoir to the apparatus to be supplied are formed by an externally threaded cylindrical ferrule 9. Furthermore, as shown in the drawing, the inside of the reservoir is occupied, from its lower end wall 3, and over a length L1, by an absorbent medium 11. A chamber 12 extending over a length L2 is provided between the upper end wall 4 of the reservoir and the absorbent medium 11. The volume of the chamber 12 is at least equal to the volume of fuel in the liquid phase in excess, that is to say it is not absorbed by the medium 11 received by the volume of liquid fuel released by the absorbent medium after turning the reservoir over.

According to another characteristic of the invention, a draw-off tube 13 equips the draw-off orifice, upstream of the pressure reducer/evaporator 8. This tube 13 is placed axially in the reservoir, and its length 1 is at least equal to the height of fuel (15) in the liquid phase, which may be in the chamber 12 when the reservoir is in an inverted position, as shown in FIG. 2.

Figure 2:
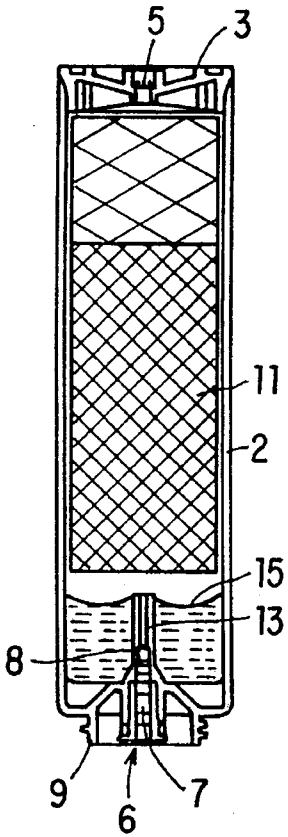
FIGS. 1 and 2 are two longitudinal sectional views of a first embodiment of this reservoir, respectively in upright position and in inverted position.
Figure 1:
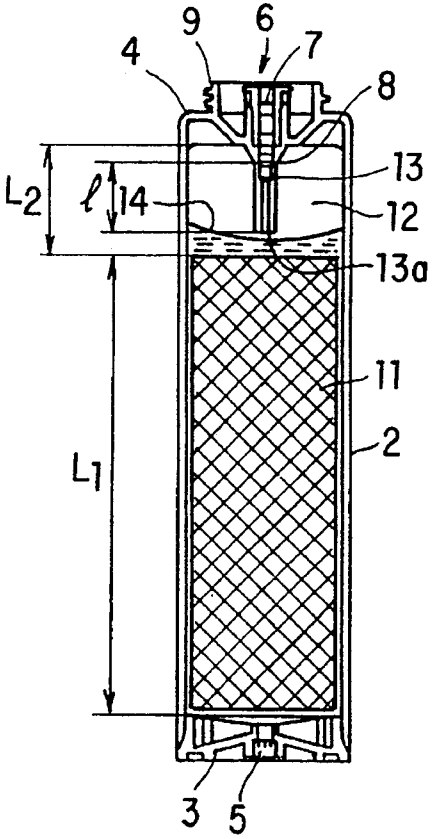

Thus, whether the reservoir is in an upright position, as shown in FIG. 1, or in an inverted position, as shown in FIG. 2, the end 13*a* of the draw-off tube is never immersed in the liquid fuel, so that the liquid phase does not reach the pressure reducer, thus ensuring excellent functioning of the the apparatus onto which the reservoir is fitted.

Figure 4:
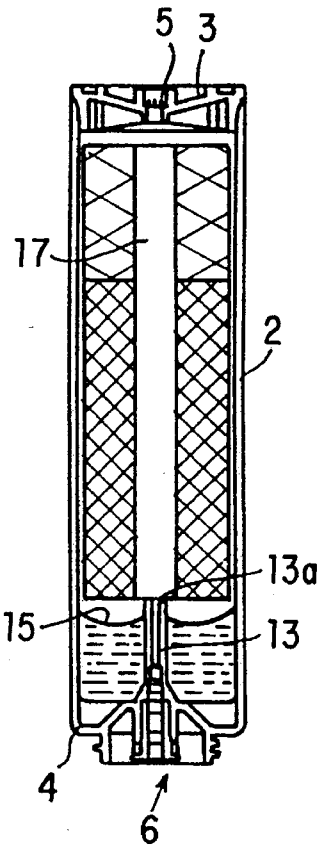
FIGS. 3 and 4 are two sectional views of a second reservoir, respectively in upright position and in inverted position.
Figure 3:
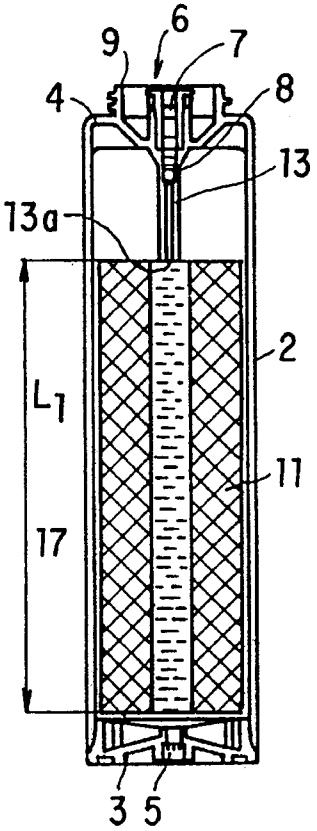

In the embodiment represented in FIGS. 3 and 4, in which the same elements are designated by the same references as previously, an axial, central absorption channel (17) extends over the entire length L1 of the absorbent medium 11, having the effect of substantially increasing the surface areas in contact with the absorbent medium 11 and the fuel in the liquid phase.

By virtue of the presence of this central absorption channel 17, the rate of absorption of the fuel in the liquid phase is of the order of 35 $cm^3$ per min. As shown in the drawing, the end 13*a* of the draw-off tube 13 is placed substantially in the plane of the upper face of the absorbent material 11.

The advantage of this second solution compared to the first is that, when the reservoir is turned by hand from its inverted position to its upright position, the fuel in the liquid phase, which was released by the absorbent medium 11, is re-absorbed more rapidly by the latter.

The reservoir represented in FIG. 5 is a variant of the reservoir of FIG. 1, in which the same elements are designated by the same references. In this reservoir, the upper face 14 of the absorbent material 11 is not plane but is formed by a convex surface, the vertex of which protrudes towards the side of the lower end wall 3 of the reservoir, thus enabling the length of the tube 13 to be increased. Such an arrangement could also be applied to the absorbent material 11 represented in FIGS. 3 and 4.

In the three examples illustrated in the drawing, the free end 13*a* of the draw-off tube 13 is represented as the open end of a normal cylindrical tube. Of course it is possible for this open free end 13*a* to be shaped differently, for example by providing an opening formed by a longitudinal slot arranged along one of the generatrices of the tube starting from one end thereof.

What is claimed is:

1. A reservoir for gaseous fuel in a liquid phase, said reservoir comprising:

an elongate cylindrical wall;

a lower end wall abutting the cylindrical wall and provided with a filling orifice;

an upper end wall abutting the cylindrical wall and provided with a draw-off orifice equipped with a draw-off member and with a pressure reducer;

an internal volume defined by the cylindrical wall and the end walls;

an absorbent medium occupying less than all of the internal volume; and a chamber defined by an unoccupied portion of the internal volume between the absorbent medium and the upper end wall, wherein the chamber has a volume that is at least equal to a volume of the fuel in the liquid phase not absorbed by the absorbent medium when the reservoir is upside down;

wherein the draw-off orifice is equipped with a draw-off tube of fine bore positioned upstream of the pressure reducer and housed axially in the chamber, and wherein the draw-off tube is of sufficient length that an innermost end of the draw-off tube is not below a level of the fuel in the liquid phase which may be present in the chamber when the reservoir is upside down.

2. The reservoir according to claim 1, wherein the absorbent medium comprises a cellulose-based non-woven fiber.

3. The reservoir according to claim 1, further comprising a central absorption channel formed along a longitudinal axis of the absorbent medium.

4. The reservoir according to claim 3, wherein the draw-off tube is aligned with the longitudinal axis of the central absorption channel, and wherein the innermost end of said draw-off tube contacts a plane defined by an upper face of the absorbent material.

5. The reservoir according to claim 1, wherein said absorbent material comprises an upper face formed by a convex surface, a vertex of which protrudes towards the lower end wall of the reservoir.

6. The reservoir according to claim 1, wherein the draw-off member is a valve.

* * * * *